US009477189B1

(12) United States Patent
Yagi et al.

(10) Patent No.: US 9,477,189 B1
(45) Date of Patent: Oct. 25, 2016

(54) BELT FIXING DEVICE HAVING MOISTURE ABSORBING MEMBER AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventors: Ryosuke Yagi, Yokohama Kanagawa (JP); Takuya Hongo, Yokohama Kanagawa (JP); Norihiro Tomimatsu, Mitaka Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/980,089

(22) Filed: Dec. 28, 2015

(30) Foreign Application Priority Data

Jul. 13, 2015 (JP) ..... 2015-139716

(51) Int. Cl.
*G03G 15/20* (2006.01)

(52) U.S. Cl.
CPC ..... *G03G 15/2053* (2013.01); *G03G 15/2017* (2013.01); *G03G 15/2064* (2013.01); *G03G 2215/2035* (2013.01)

(58) Field of Classification Search
CPC ..... G03G 15/2017; G03G 15/206; G03G 15/2053; G03G 15/2064; G03G 2215/2016; G03G 2215/2035
USPC ..... 399/328, 329, 333; 219/216
See application file for complete search history.

(56) References Cited

U.S. PATENT DOCUMENTS 5,223,902 A * 6/1993 Chodak ..... G03G 15/2028 399/328
5,583,608 A * 12/1996 Nomura ..... G03D 3/132 219/216
6,219,521 B1 * 4/2001 Burdick ..... G03G 15/2025 399/327
6,957,036 B2 * 10/2005 Kikuchi ..... G03G 15/2057 399/329
7,734,241 B2 6/2010 Nishida et al.
2008/0138131 A1 6/2008 Jung et al.

(Continued)

FOREIGN PATENT DOCUMENTS

JP 60104982 A * 6/1985
JP H06-019345 1/1994

(Continued)

OTHER PUBLICATIONS

Japanese Office Action mailed Jun. 7, 2016, filed in Japanese Patent Application No. 2015-139716, 7 pages (with English translation).

*Primary Examiner* — Robert Beatty
(74) *Attorney, Agent, or Firm* — Patterson & Sheridan, LLP

(57) ABSTRACT

According to one embodiment, a fixing device includes a cylinder-shaped rotatable fixing belt and a pressurizing rotating member which is arranged so as to face the fixing belt along an axial direction, and transports a recording medium by rotating along with the fixing belt. In addition, arranged in the fixing belt, a pressurizing member which presses the fixing belt from an inner peripheral portion toward the pressurizing rotating member side, and a support member which supports the pressurizing member, and arranged a moisture absorbing layer which absorbs moisture in air and discharges the absorbed moisture according to a temperature rise between the support member and the pressurizing member.

8 Claims, 6 Drawing Sheets

(56) References Cited

U.S. PATENT DOCUMENTS

| | | | |
|---|---|---|---|
| 2008/0273904 | A1 | 11/2008 | Nishida et al. |
| 2014/0356015 | A1 | 12/2014 | Kawai |

FOREIGN PATENT DOCUMENTS

| | | | | |
|---|---|---|---|---|
| JP | 11024472 | A | * | 1/1999 |
| JP | 2000214715 | A | * | 8/2000 |
| JP | 2001305899 | A | * | 11/2001 |
| JP | 2005213660 | A | * | 8/2005 |
| JP | 2007298554 | | | 11/2007 |
| JP | 2008122719 | A | * | 5/2008 |
| JP | 2008146067 | | | 6/2008 |
| JP | 2008299314 | | | 12/2008 |
| JP | 2009276418 | | | 11/2009 |
| JP | 2014102397 | | | 6/2014 |
| JP | 2015-007756 | | | 1/2015 |

* cited by examiner

FIG. 10A
| | EMBODIMENT | COMPARISON EXAMPLE |
|---|---|---|
| TEMPERATURE DIFFERENCE ΔT (℃) | 55℃ | 65℃ |
| STARTUP TIME N (SECONDS) | 34 SECONDS | 42 SECONDS |
FIG. 10B
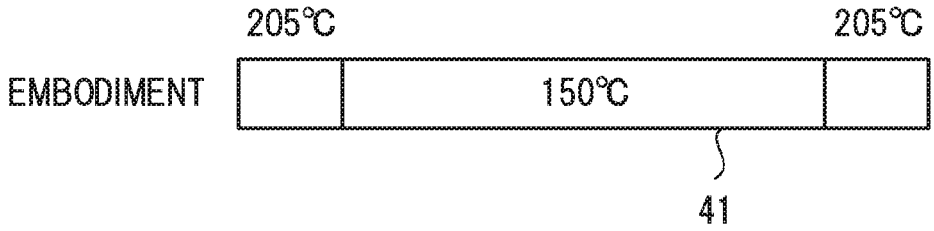
FIG. 10C
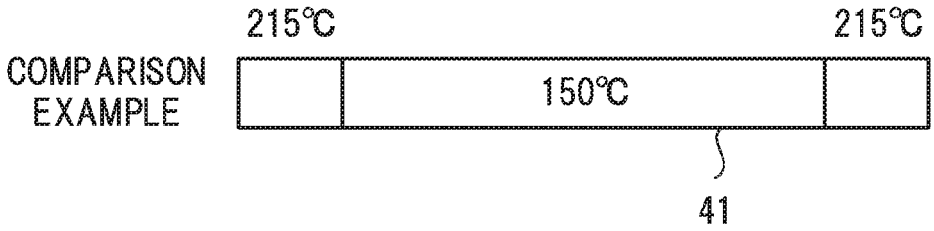

BELT FIXING DEVICE HAVING MOISTURE ABSORBING MEMBER AND IMAGE FORMING APPARATUS

CROSS-REFERENCE TO RELATED APPLICATION

This application is based upon and claims the benefit of priority from the prior Japanese Patent application No. 2015-139716, filed on Jul. 13, 2015, the entire contents of which are incorporated herein by reference.

FIELD

Embodiments described herein relate generally to a fixing device which fixes a toner image onto a recording medium such as a sheet. In addition, the embodiments relate to an image forming apparatus which forms an image on a recording medium using the fixing device.

BACKGROUND

In the related art, an image forming apparatus which forms an image on a recording medium (for example, sheet) as a printing target is known. The image forming apparatus forms a toner image in a transfer unit, and transfers the toner image onto a sheet which is supplied to the transfer unit. The sheet onto which the toner image is transferred is heated and pressurized using a fixing unit, and the toner image is fixed onto the sheet.

The fixing unit includes a fixing belt including a heat source, and a pressurizing roller which faces the fixing belt and which applies a pressure to a sheet. The fixing unit interposes a sheet between the fixing belt and the pressurizing roller, melts toner by applying heat and a pressure, and fixes a toner image onto the sheet.

Usually, a width of the fixing belt is larger than that of a sheet. For this reason, a contact region which comes into contact with a sheet is present at a center portion of the fixing belt, and a non-contact region which does not come into contact with a sheet is present at an end portion of the fixing belt. Accordingly, heat moves to a sheet at the center portion of the fixing belt in the axial direction, when the center portion comes into contact with the sheet. Meanwhile, heat rises at both end portions of the fixing belt in the axial direction, and temperature irregularity occurs in the fixing belt, since both end portions do not come into contact with a sheet.

When temperature irregularity occurs in the fixing belt, there is a concern that a fixing failure or abnormal heating may be caused, and the fixing belt itself, or peripheral members of the fixing belt may ignite, and may be damaged. In addition, in order to cool down a temperature of the non-contact region, it is necessary to stop a fixing operation.

DESCRIPTION OF THE DRAWINGS

FIGS. 10A to 10C are explanatory diagrams which illustrate a heat leveling effect of a fixing belt, and an evaluation result of a startup time in the fixing device according to the second embodiment.

DETAILED DESCRIPTION

Figure 1:
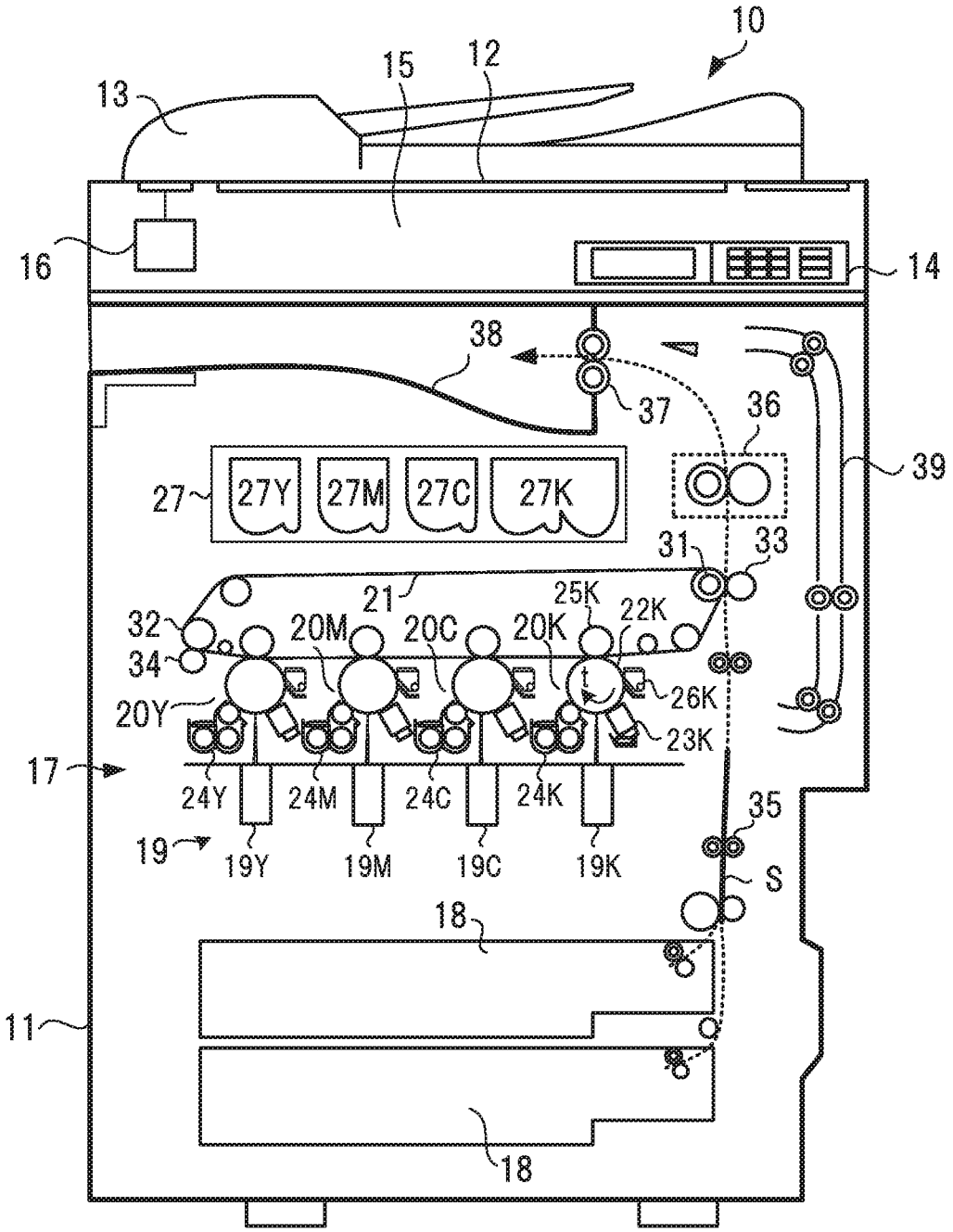
FIG. 1 is a configuration diagram which illustrates an image forming apparatus according to a first embodiment.

In general, according to one embodiment, a fixing device which fixes a toner image formed on a recording medium onto the recording medium includes: a cylinder-shaped rotatable fixing belt which heats and melts a toner image formed on the recording medium; a pressurizing rotating member which is arranged so as to face the fixing belt along an axial direction, and transports the recording medium by rotating along with the fixing belt; a pressurizing member which is arranged inside the fixing belt, and forms a nip portion by pressing the fixing belt from an inner peripheral portion toward the pressurizing rotating member side; a support member which supports the pressurizing member; and a moisture absorbing layer which is arranged between the support member and the pressurizing member, absorbs moisture in air, and discharges the absorbed moisture according to a temperature rise.

Hereinafter, the embodiment will be described with reference to drawings. The same portion in each figure will be given the same reference numeral.

First Embodiment

FIG. 1 is a configuration diagram which illustrates an image forming apparatus according to a first embodiment. In FIG. 1, an image forming apparatus 10 is, for example, a Multi-Function Peripheral (MFP) as a multifunction printer, a printer, a copy machine, a fax machine, or the like. In the following descriptions, the MFP will be described as an example.

A document table 12 which is made of transparent glass is provided at the upper part of a main body 11 of an MFP 10. An automatic document feeder (ADF) 13 is provided on the document table 12 in an openable-closable manner. An operation panel 14 is provided at the upper part of the main body 11. The operation panel 14 includes various keys and a touch panel-type display unit.

A scanner unit 15 as an image reading unit is provided at the lower part of the ADF 13 in the main body 11. The scanner unit 15 reads the original document which is sent using the ADF 13, or the original document which is placed on the document table, and generates image data. The scanner unit 15 includes an image sensor 16. The image sensor 16 is arranged in the main scanning direction (depth direction in FIG. 1).

A printer unit 17 which configures an image forming unit is provided at a center portion in the main body 11. A plurality of cassettes 18 which accommodate sheets of various sizes are provided at the lower part of the main body 11. The printer unit 17 includes a photoconductive drum, an exposure unit, and the like. The exposure unit includes a scanning head 19 which includes LEDs as light emitting elements. The printer unit 17 scans the photoconductive drum using a ray of light from the scanning head 19, and generates an image.

The printer unit 17 forms an image on a recording medium which is a printing target by processing image data which is read in the scanner unit 15, or image data which is created using a personal computer (PC), or the like. In the following descriptions, a case in which a sheet S is used as a recording medium will be exemplified, however, as the recording medium, also possible to use an OHP sheet, or the like.

The printer unit 17 is, for example, a tandem-type color laser printer. The printer unit 17 includes image forming stations 20Y, 20M, 20C, and 20K of each color of yellow (Y), magenta (M), cyan (C), and black (K). The image forming stations 20Y, 20M, 20C, and 20K are arranged in parallel on the lower side of an intermediate transfer belt 21 from the upstream side to the downstream side. Also the scanning head 19 arranges a plurality of scanning heads 19Y, 19M, 19C, and 19K in the main scanning direction corresponding to the image forming stations 20Y, 20M, 20C, and 20K.

The image forming stations 20Y, 20M, 20C, and 20K have the same configuration. Accordingly, the image forming station 20K will be representatively described. The image forming station 20K includes a photoconductive drum 22K as an image carrier. At the periphery of the photoconductive drum 22K, a charger 23K, a developing unit 24K, a primary transfer roller 25K, a cleaner 26K, and the like, are arranged along a rotation direction t of the photoconductive drum 22K. Light from the scanning head 19K is radiated to an exposure position of the photoconductive drum 22K, and an electrostatic latent image is held on the photoconductive drum 22K.

The charger 23K uniformly charges the entire surface of the photoconductive drum 22K. The developing unit 24K supplies a two-component developer which includes black toner and a carrier to the photoconductive drum 22K using a developing roller to which a developing bias is applied. A toner image is formed on the photoconductive drum 22K. The cleaner 26K removes residual toner on the surface of the photoconductive drum 22K.

A toner cartridge 27 which supplies toner to developing units 24Y to 24K is provided at the upper part of the image forming stations 20Y to 20K. The toner cartridge 27 includes toner cartridges 27Y, 27M, 27C, and 27K of each color of yellow (Y), magenta (M), cyan (C), and black (K).

The intermediate transfer belt 21 is stretched so as to be laid on a driving roller 31 and a driven roller 32, and circularly moves. The intermediate transfer belt 21 comes into contact with the photoconductive drum 22K by facing. The primary transfer roller 25K is provided at a position of the intermediate transfer belt 21 which faces the photoconductive drum 22K. A primary transfer voltage is applied to the intermediate transfer belt 21 using the primary transfer roller 25K, and a toner image on the photoconductive drum 22K is primarily transferred to the intermediate transfer belt 21.

A secondary transfer roller 33 is arranged in facing the driving roller 31 on which the intermediate transfer belt 21 is stretched. When the sheet S passes between the driving roller 31 and the secondary transfer roller 33, a secondary transfer voltage is applied to the sheet S using the secondary transfer roller 33. A toner image on the intermediate transfer belt 21 is secondarily transferred to the sheet S. A belt cleaner 34 is provided in the vicinity of the driven roller 32 of the intermediate transfer belt 21.

The scanning head 19K functions as the exposure unit by facing the photoconductive drum 22K. The photoconductive drum 22K rotates at a preset rotation speed, and stores charges on the surface. An electrostatic latent image is formed on the surface of the photoconductive drum 22K when light from the scanning head 19K is radiated to the photoconductive drum 22K, and is exposed. The scanning heads 19Y, 19M, and 19C similarly form an electrostatic latent image on the surface of the photoconductive drum of corresponding image forming stations 20Y, 20M, and 20C.

In addition, as the exposer unit of the photoconductive drum 22, a laser exposure device may be used, instead of the scanning head 19. The laser exposure device scans a laser beam which is emitted from a semiconductor laser element in the main scanning direction of the photoconductive drums 22K to 22C using a polygon mirror.

As illustrated in FIG. 1, a transport roller 35 is provided at a position between the sheet feeding cassette 18 and the secondary transfer roller 33. The transport roller 35 transports the sheet S which is taken out from the inside of the sheet feeding cassette 18. A fixing device 36 is provided on the downstream side of the secondary transfer roller 33. The fixing device 36 includes a fixing belt which includes a heat source as will be described later, and a pressurizing roller which applies a pressure to the sheet S by facing the fixing belt. The fixing device 36 interposes the sheet S between the fixing belt and the pressurizing roller, melts toner by applying heat and a pressure to the sheet S, and fixes a toner image onto the sheet S.

A transport roller 37 is provided on the downstream side of the fixing device 36. The transport roller 37 discharges the sheet S to a sheet discharging unit 38. A reversing transport path 39 is provided on the downstream side of the fixing device 36. The sheet S is transported to the reversing transport path 39 by switching back, when the sheet S is temporarily transported in a direction of the sheet discharging unit 38, and the transport roller 37 is reversely rotated. The reversing transport path 39 guides the sheet S in a direction of the secondary transfer roller 33 by reversing the sheet S. The reversing transport path 39 is used when performing double-sided printing.

In addition, the printer unit of the image forming apparatus 10 is not limited to the tandem type, and may be another type. Also, the number of developing units 24 is not limited to four.

Figure 2:
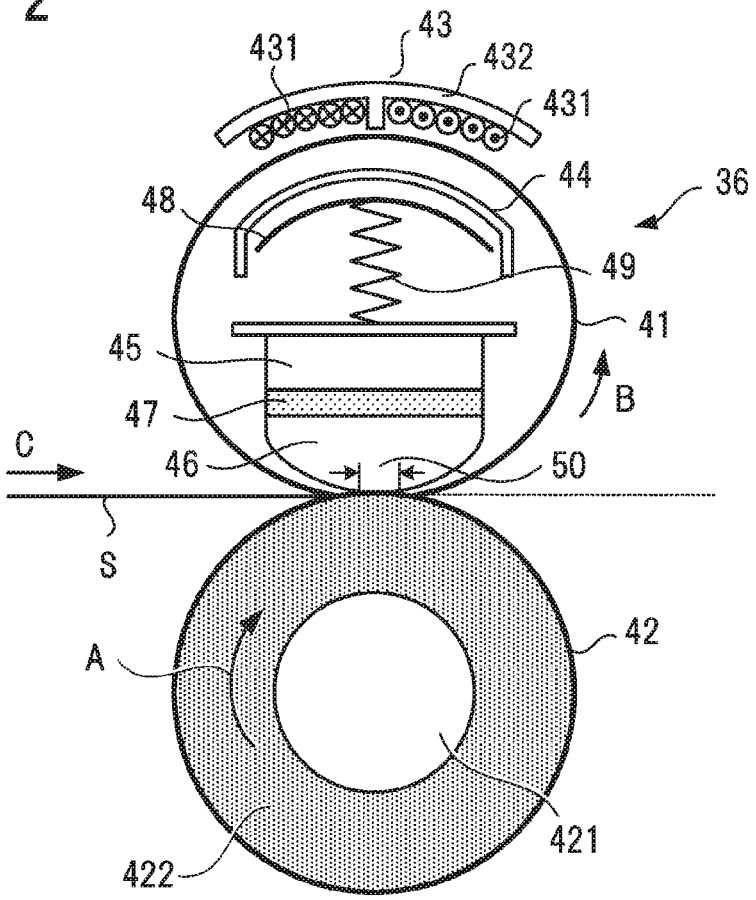
FIG. 2 is a schematic configuration diagram a fixing device according to the first embodiment which is viewed from a side.
Figure 3:
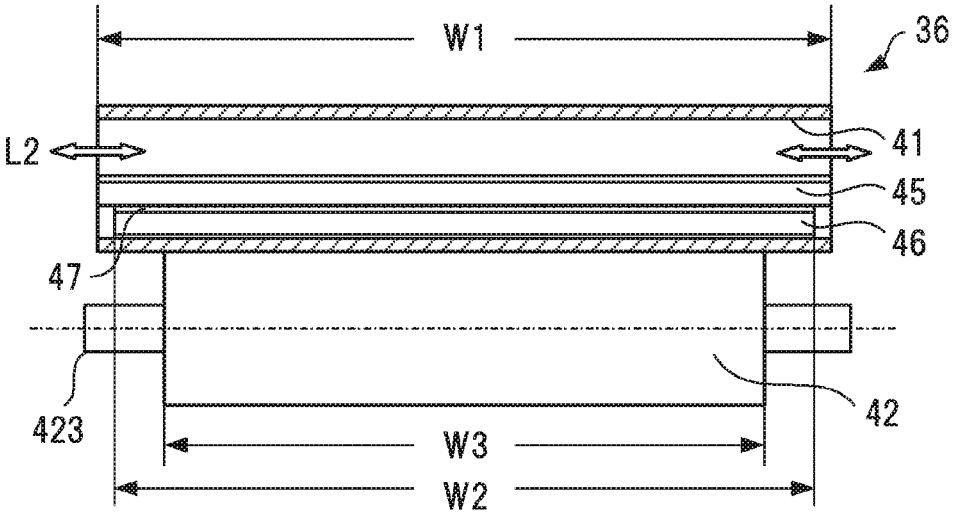
FIG. 3 is a schematic configuration diagram the fixing device according to the first embodiment which is viewed in the longitudinal direction.

Subsequently, the fixing device 36 according to the first embodiment will be described with reference to FIG. 2 and FIG. 3. FIG. 2 is a schematic configuration diagram when the fixing device 36 which is viewed from a side. FIG. 3 is a schematic configuration diagram the fixing device 36 which is viewed in the longitudinal direction, and a part (fixing belt) thereof is illustrated as a section.

As illustrated in FIG. 2, the fixing device 36 includes a fixing belt 41, a pressurizing roller 42, and an electromagnetic induction heating coil unit 43. The fixing belt 41 is formed in an endless cylindrical shape which includes a conductive layer. The pressurizing roller 42 is a pressurizing rotating member. Hereinafter, the electromagnetic induction heating coil unit 43 will be referred to as an IH coil unit 43. The pressurizing roller 42 rotates around a rotating shaft 423 which is illustrated in FIG. 3.

The fixing belt 41 includes a layer which is induction heated due to a magnetic field of the IH coil unit 43, for example, a conductive layer which is formed of a conductive material such as iron, nickel, and copper. Alternatively, a copper layer may be stacked on a nickel layer. An elastic layer which is formed of an elastic body such as silicon rubber is included on the conductive layer, and a release layer which is easily released from toner such as PFA is included on the surface of the elastic layer.

The pressurizing roller 42 includes an elastic layer 422 such as a rubber layer with a heat-resisting property at the periphery of a metallic core member 421. The pressurizing roller 42 includes a separation layer which is formed of a fluorine-based resin, or the like, on a surface. The pressurizing roller 42 is arranged so as to face the fixing belt 41 along the axial direction. The pressurizing roller 42 and the fixing belt 41 face each other on the circumference. The fixing belt 41 rotates along with the pressurizing roller 42 due to a rotation of the pressurizing roller, and the pressurizing roller 42 and the fixing belt 41 transport the sheet S.

The IH coil unit 43 is arranged at the outer periphery of the fixing belt 41. The IH coil unit 43 includes a coil 431, and a core 432 which regulates a magnetic flux of the coil 431 by covering the outer periphery of the coil 431. A magnetic member 44 is arranged with respect to the IH coil unit 43 in the inside of the fixing belt 41. The IH coil unit 43 causes a high-frequency current to flow to the coil 431, and generates a magnetic flux in a direction of the fixing belt 41. Due to the magnetic flux from the IH coil unit 43, the conductive layer of the fixing belt 41 is heated by generating an eddy current, and heats the fixing belt 41.

A pressurizing pad 46 and a frame 45 are included in the fixing belt 41. The pressurizing pad 46 is a pressurizing member, and the frame 45 is a support member which supports the pressurizing pad 46. A moisture absorbing layer 47 is provided between the pressurizing pad 46 and the frame 45. A shield 48 is arranged by facing the magnetic member 44. A spring 49 as a pressure applying member is provided between the shield 48 and the frame 45. Due to an elastic force of the spring 49, the frame 45 presses the pressurizing pad 46 against the fixing belt 41.

The pressurizing pad 46 is arranged inside the fixing belt 41. The pressurizing pad 46 is located at a position facing the pressurizing roller 42 by interposing the fixing belt 41 therebetween. A nip portion 50 is formed between the fixing belt 41 and the pressurizing roller 42 when the fixing belt 41 is pressed in a direction of the pressurizing roller 42 from the inner peripheral portion using the pressurizing pad 46.

The pressurizing pad 46 is formed of an aluminum member, a coated metal member, or a resin with a heat-resisting property (for example, PEEK material, phenol resin). When a pressure of the spring 49 is applied to the pressurizing pad 46, a pressure is applied between the fixing belt 41 and the pressurizing roller 42, and the nip portion 50 is formed. In addition, not illustrated, a low friction sheet may be arranged between the pressurizing pad 46 and the fixing belt 41. The low friction sheet makes a sliding property between the pressurizing pad 46 and the fixing belt 41 good.

The moisture absorbing layer 47 is a layer which absorbs moisture in air, and discharges the absorbed moisture according to a temperature rise, and configures a member for leveling heat which promotes heat leveling of the fixing belt 41 in the axial direction. The moisture absorbing layer 47 absorbs moisture of 50 mg/m$^3$ to 800 mg/m$^3$ per unit volume under a circumstance of a temperature of 25° C., and a relative humidity of 10% or more. In addition, the moisture absorbing layer 47 discharges moisture (water vapor), and an absorbing amount of moisture is reduced by being heated.

The moisture absorbing layer 47 is formed by holding a non-organic moisture absorbing material and an organic moisture absorbing material in a porous base material, or mixing thereof in the base material (to be impregnated). Specifically, as the non-organic moisture absorbing material, zeolite, silica gel, calcium chloride, lithium chloride, or the like, is used. As the organic moisture absorbing material, poly urethane, acryl, or the like, is used. As the porous base material, cellulose, a carbon porous body, a metal porous body, or the like, is used.

It is preferable to set a vapor discharging temperature of the moisture absorbing layer 47 when being heated to be in a range of 70° C. to 150° C. The thickness of the moisture absorbing layer 47 is approximately 1 mm to 2 mm, and the thickness of the pressurizing pad 46 is approximately 10 mm. The moisture absorbing layer 47 is fixed between the pressurizing pad 46 and the frame 45 by being interposed in a sandwiching manner when the pressurizing pad 46 is attached to the frame 45. In addition, possible to use an arbitrary structure in order to attach the pressurizing pad 46 to the frame 45. For example, possible to use an arbitrary fixing method such as a structure in which a claw which is formed in the pressurizing pad 46 is hooked on the frame 45, and is fixed.

The fixing device 36 rotatably drives the rotating shaft 423 (FIG. 3) of the pressurizing roller 42 using a motor. When the pressurizing roller 42 rotates, the fixing belt 41 rotates following the pressurizing roller 42. As a matter of course, the fixing belt 41 may be driven by itself. For example, when the pressurizing roller 42 rotates in the arrow A direction in FIG. 2, the fixing belt 41 rotates in the arrow B direction. The fixing belt 41 transports the sheet S in the arrow C direction by interposing the sheet S in the nip portion 50 between the fixing belt 41 and the pressurizing roller 42. Accordingly, toner is melted by applying heat and a pressure to the sheet S, and a toner image is fixed onto the sheet S.

An intermediate region of the fixing belt 41 in the axial direction is free, and is in a state of no tension. The intermediate region of the fixing belt 41 in the axial direction comes into contact with the pressurizing roller 42 at a position of the pressurizing pad 46, is pressurized, and is deformed.

As illustrated in FIG. 3, in the fixing device 36, when the width of the fixing belt 41 in the longitudinal direction is set to W1, a relationship with the width W2 of the pressurizing pad 46, and the width W3 of the pressurizing roller 42 becomes W1>W2>W3. Here, the longitudinal direction is a direction which is orthogonal to the transport direction of the sheet S, that is, a direction parallel to the axial direction of the fixing belt 41.

That is, sheets S of various sizes are supplied to the fixing device 36. As the sheet size, there is, for example, an LT size, an A4 size, an A4-R size, an LT-R size, an ST-R size, or the like, and sheets S with various widths are supplied to the fixing device 36. Accordingly, the width W1 of the fixing belt 41 is designed so as to be larger than the width of the sheet S.

By the way, since the center portion of the fixing belt 41 in the axial direction comes into contact with the sheet S during a fixing operation, heat in the contact region is drawn due to the sheet S. Meanwhile, since both end portions of the fixing belt 41 in the axial direction are not in contact with the sheet S, and heat in the non-contact region is not drawn due to the sheet S, and a temperature of the fixing belt 41 rises.

When a temperature of the fixing belt 41 corresponding to the non-contact region continuously rises, and the sheet S is supplied to the region in which the temperature rises, there is a case in which a fixing failure occurs. Also, there is a concern that abnormal heating may be caused, and the fixing belt 41 itself, or peripheral members of the fixing belt 41 may ignite, and may be damaged. Meanwhile, when cooling down a temperature in the non-contact region, a fixing operation should be stopped by stopping energization of the coil 431 of the IH coil unit 43.

Therefore, according to the first embodiment, the moisture absorbing layer 47 is provided between the frame 45 and the pressurizing pad 46.

Figure 4:
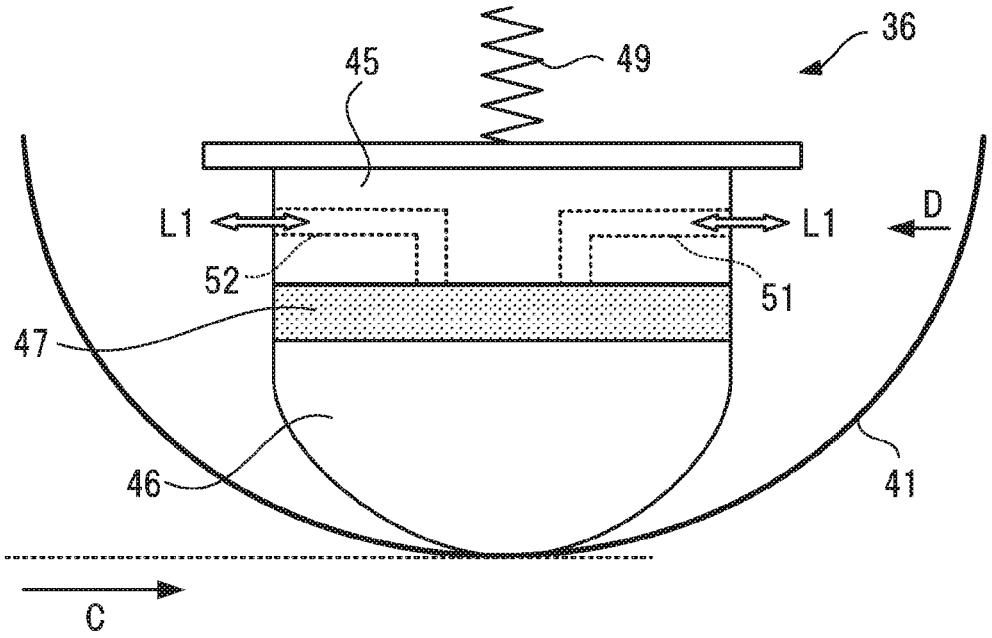
FIG. 4 is an enlargement side view which illustrates a configuration of main portions of the fixing device according to the first embodiment.

FIG. 4 is an enlargement side view which illustrates main portions of the fixing device 36. In FIG. 4, portions of the frame 45, the pressurizing pad 46, and the moisture absorbing layer 47 of the fixing device 36 are illustrated. In the frame 45, openings 51 and 52 for absorbing and discharging moisture (water vapor) lead from the moisture absorbing layer 47 to the inside of the fixing belt 41 are provided.

A plurality of the openings 51 and 52 are provided in line along the longitudinal direction on a side face of the frame 45. As illustrated in FIG. 4, the opening 51 is formed in a cylindrical shape by being bent in L-shape, and penetrates toward one side face of the frame 45 from the moisture absorbing layer 47. The opening 52 is symmetrically formed with respect to the opening 51 so as to penetrate toward the other side face of the frame 45 from the moisture absorbing layer 47.

In a room temperature state in which an operation of the fixing device 36 is stopped, the moisture absorbing layer 47 absorbs moisture in the fixing belt 41 through the openings 51 and 52. Therefore, a humidity in the fixing belt 41 falls, and due to an inclination of moisture concentration in the inside and outside of the fixing belt 41, moisture on the outside of the fixing belt 41 diffuses into the fixing belt 41.

In addition, the moisture absorbing layer 47 discharges absorbed moisture as water vapor (vaporization heat) by being heated. The discharged water vapor is discharged into the fixing belt 41 through the openings 51 and 52 in the frame 45. The water vapor in the fixing belt 41 is discharged from both ends of the fixing belt 41 in the axial direction, and causes a temperature to fall when the fixing belt 41 is in an overheated state.

Absorbing and discharging of moisture which is performed through the openings 51 and 52 is performed through the line L1 in FIG. 4. Discharging of water vapor from both ends of the fixing belt 41 in the axial direction is performed through the line L2 in FIG. 3.

Accordingly, when the fixing belt 41 is heated, a temperature rises in the non-contact region with the sheet S of the fixing belt 41 compared to the center portion. However, water vapor in the fixing belt 41 is discharged from both ends in the axial direction, that is, the water vapor is discharged to the outside of the fixing belt 41 through the line L2. As a result, a humidity in the fixing belt 41 falls. Since the line L2 is close to the non-contact region with the sheet S of the fixing belt 41, possible to efficiently lower a temperature when a temperature in the non-contact region is rises.

Figure 5:
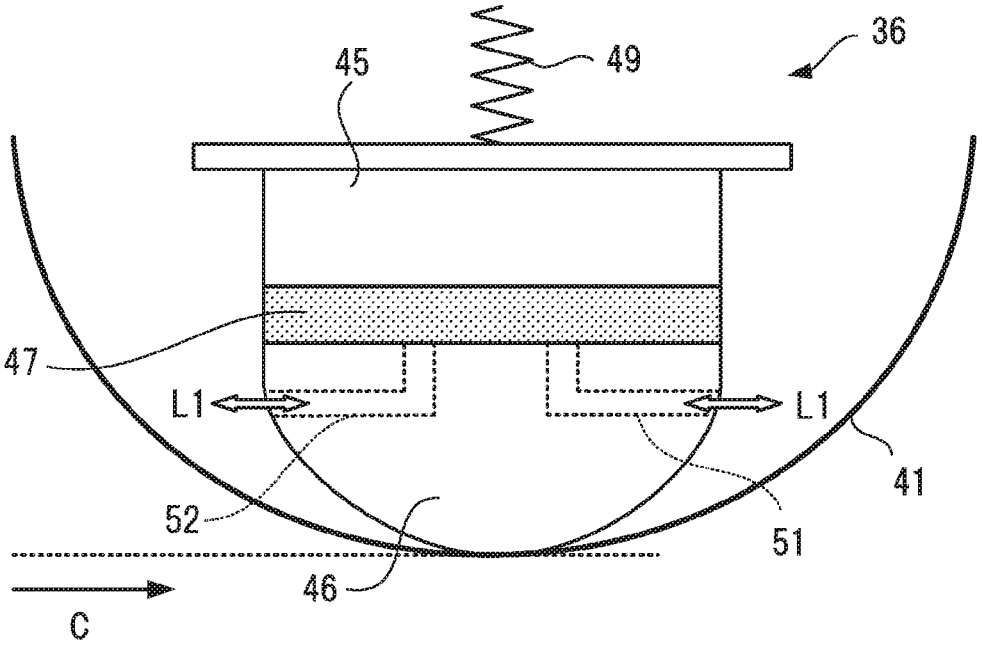
FIG. 5 is an enlargement side view which illustrates another configuration of the main portions of the fixing device according to the first embodiment.

FIG. 5 is an enlargement side view which illustrates another configuration of the main portions of the fixing device 36. FIG. 5 illustrates an example in which the openings 51 and 52 are provided in the pressurizing pad 46. In FIG. 5, the opening 51 is formed in a cylindrical shape by being bent in L-shape, and penetrates toward one side face of the pressurizing pad 46 from the moisture absorbing layer 47. The opening 52 is symmetrically formed with respect to the opening 51 by penetrating toward the other side face of the pressurizing pad 46 from the moisture absorbing layer 47.

In FIG. 5, when the moisture absorbing layer 47 is heated, water vapor in the moisture absorbing layer 47 is discharged into the fixing belt 41 through the line L1. The water vapor in the fixing belt 41 is discharged to the outside of the fixing belt 41 through the line L2 from both end portions of the fixing belt 41. Since the line L2 (FIG. 3) is close to the non-contact region with the sheet S of the fixing belt 41, possible to efficiently lower a temperature when the temperature in the non-contact region is rises.

The openings 51 and 52 may be respectively provided in the frame 45 and the pressurizing pad 46. The openings 51 and 52 can be formed using a mold when molding the frame 45 or the pressurizing pad 46. A diameter of the openings 51 and 52 is approximately 1 mm to 2 mm in size. When the diameter of the openings 51 and 52 is set to be extremely large, intensity of the frame 45 or the pressurizing pad 46 decreases. Accordingly, it is preferable to set the diameter, the number of openings 51 and 52, or the like, in consideration of intensity of the frame 45 or the pressurizing pad 46.

Figure 6:
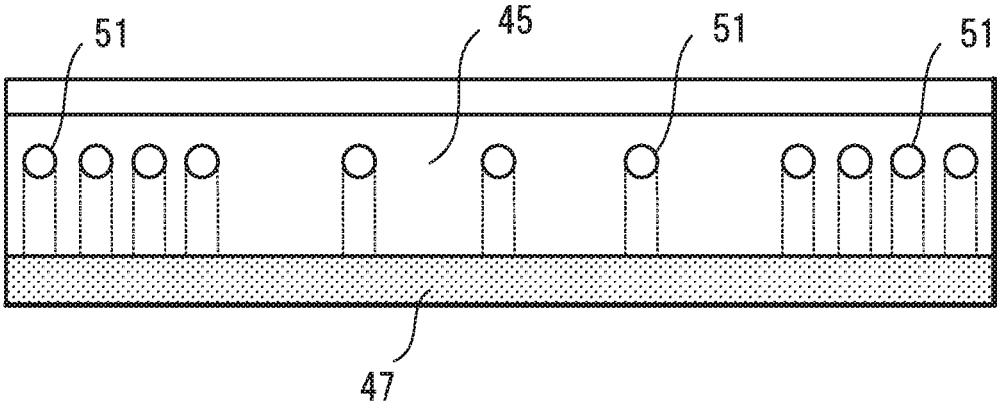
FIG. 6 is an explanatory diagram which illustrates an arrangement of openings which are formed in a frame in the fixing device according to the first embodiment.

FIG. 6 is an explanatory diagram which illustrates an arrangement of the opening 51 which is formed in the frame 45. FIG. 6 is a diagram of the frame 45 which is viewed in the longitudinal direction (diagram which is viewed in arrow D direction in FIG. 4).

As illustrated in FIG. 6, the openings 51 are arranged in line in the longitudinal direction of the frame 45. The openings 51 are densely arranged in line at both end portions of the frame 45 in the longitudinal direction, and are sparsely arranged in line at the center portion. That is, set so that a lot of moisture absorbing and discharging operations are performed at both end portions rather than the center portion of the pressurizing pad 46.

Figure 7:
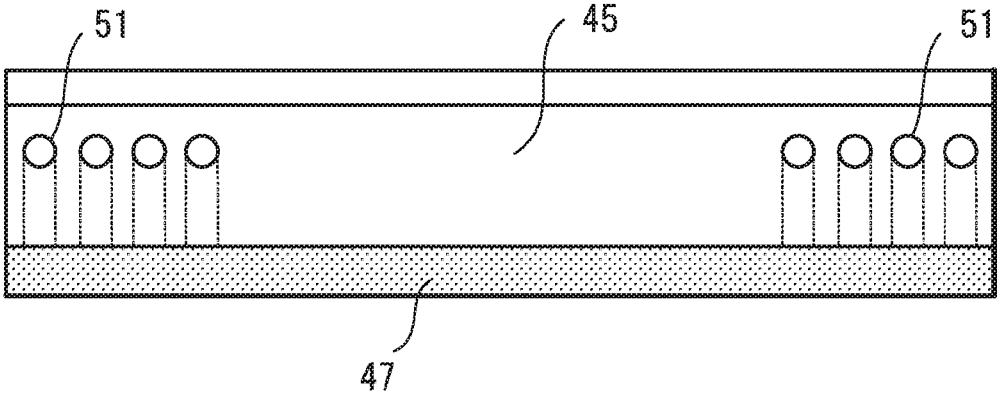
FIG. 7 is an explanatory diagram which illustrates another arrangement of the openings which are formed in a frame in the fixing device according to the first embodiment.

FIG. 7 is an explanatory diagram which illustrates another arrangement of the opening 51 which is formed in the frame 45. FIG. 7 is a view in which the frame 45 is viewed in the longitudinal direction. As illustrated in FIG. 7, the openings 51 are arranged in line along the longitudinal direction of the frame 45. The openings 51 are provided only at both end portions of the frame 45 in the longitudinal direction, and are not provided at the center portion. Also in the example in FIG. 7, a lot of moisture absorbing and discharging operations are performed at both end portions rather than the center portion of the moisture absorbing layer 47. Accordingly, possible to efficiently suppress a temperature rise in the non-contact region with the sheet S when a temperature of the fixing belt 41 is rises.

That is, as is understood from FIGS. 6 and 7, a lot of openings 51 are formed at both end portions compared to the center portion of the frame 45 in the longitudinal direction. In FIGS. 6 and 7, the arrangement of the openings 51 which are formed on one side face of the frame 45 is described. Meanwhile, also in the openings 52 which are formed on the other side face of the frame 45, similarly, set so that the openings 52 are densely arranged in line at both end portions of the frame 45 in the longitudinal direction, and are sparsely arranged in line, or are not arranged at the center portion. As illustrated in FIG. 5, also if in which the openings 51 and 52 are formed in the pressurizing pad 46, set so that the openings 51 and 52 are densely arranged in line at both end portions of the pressurizing pad 46 in the longitudinal direction, and are sparsely arranged in line, or are not arranged at the center portion.

Subsequently, an operation method of the fixing device 36 will be described. When an order of fixing the sheet S is received, the coil 431 of the IH coil unit 43 is electrified. The fixing belt 41 is heated using induction heating, and a temperature thereof rises up to a predetermined temperature. The fixing belt 41 is pressed to the pressurizing roller 42 side when an urging force of the spring 49 is set to be strong, and the nip portion 50 is formed between the fixing belt 41 and the pressurizing roller 42. When the nip portion is formed in a state in which the temperature of the fixing belt 41 is stabilized, the startup mode is finished.

When the sheet S on which toner is transferred is supplied to the nip portion 50, heat and a pressure is applied to the sheet S, and a toner image is fixed onto the sheet S. In the fixing belt 41, a temperature in the contact region with the sheet S is suppressed so that fixing conditions with respect to the sheet S are stabilized during the fixing operation. When fixing to the sheet S is finished, the fixing belt 41 is separated from the pressurizing roller 42 by controlling the urging force using the spring 49, and energization of the coil 431 is stopped.

In a period in which the fixing device 36 is stopped, since the fixing belt 41 is not heated, a temperature of the fixing belt 41 is lowered almost to a room temperature. In a space such as an office in which the image forming apparatus 10 is used, it is determined that a relative humidity in the space is maintained at 40% or more and 70% or less based on the management standard of environmental sanitation for buildings. Accordingly, the moisture absorbing layer 47 of which a temperature falls when stopping the image forming apparatus 10 can absorb moisture in air through the openings 51 and 52.

Meanwhile, when a fixing operation is performed, the fixing belt 41 is heated, and a temperature of the moisture absorbing layer 47 rises, water vapor is discharged from the moisture absorbing layer 47 through the openings 51 and 52. Since the moisture absorbing layer 47 absorbs heat when discharging water vapor, the pressurizing pad 46 which comes into contact with the moisture absorbing layer 47 is cooled down. As a result, it is possible to suppress a temperature rise of the fixing belt 41.

According to the embodiment, since water vapor is used in cooling down as vaporization heat, possible to promote heat leveling of the fixing belt 41 in the axial direction. Since the heat leveling member can be arranged in the fixing belt 41, the embodiment is possible to realize space saving. Also, the embodiment is possible to reduce the width of the nip portion 50, or to suppress deformation of the shape, and to increase reliability of image forming.

When the image forming apparatus 10 is operated under high temperature and high humidity circumstances, moisture which is included in the sheet S in advance is accumulated in the fixing device 36, and there is a possibility that dew condensation may occur during stopping of an operation. However, when moisture is discharged before stopping the moisture absorbing layer 47 (at time of previous operation), possible to reduce dew condensation since the moisture absorbing layer 47 absorbs moisture during stopping of the operation.

Therefore, the first embodiment is possible to promote heat leveling by preventing overheating of the fixing device 36.

Second Embodiment

Figure 8:
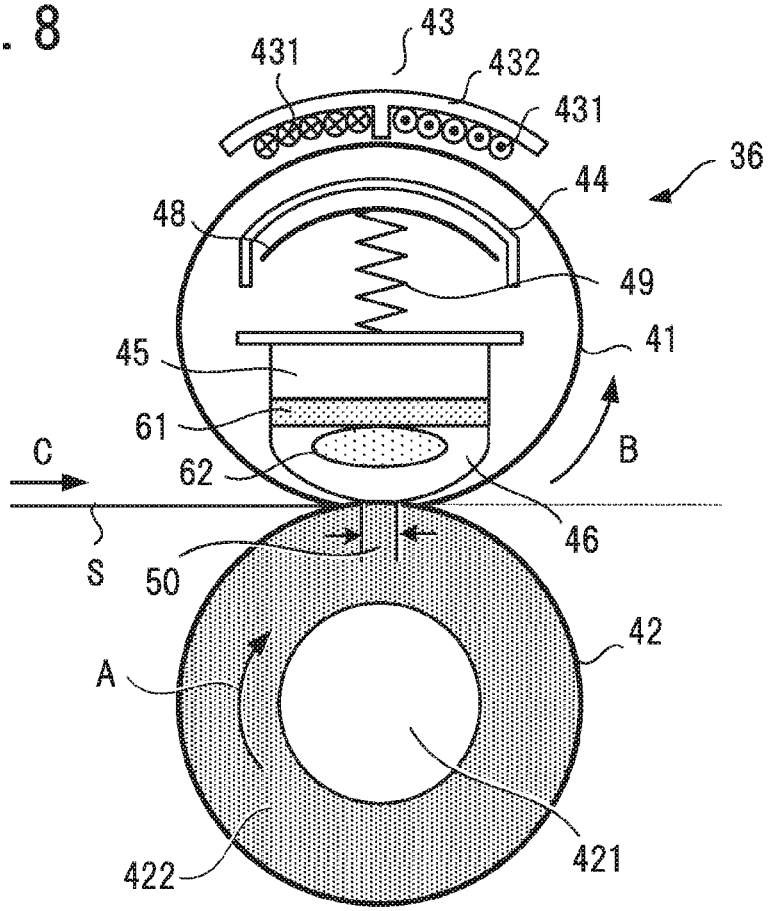
FIG. 8 is a schematic configuration diagram of a fixing device according to a second embodiment which is viewed from a side.
Figure 9:
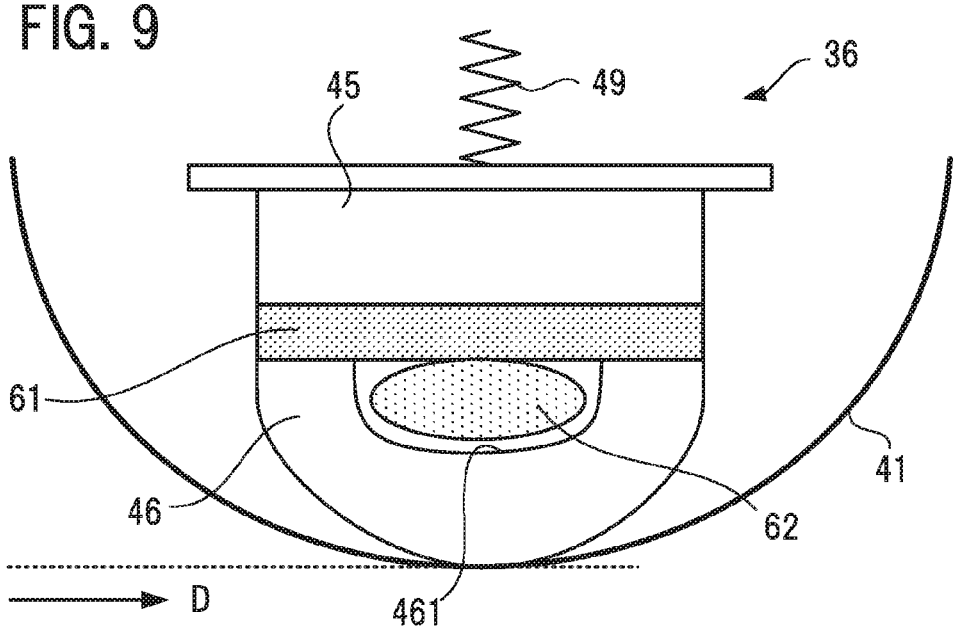
FIG. 9 is an enlargement side view which illustrates a configuration of main portions of the fixing device according to the second embodiment.

Subsequently, a fixing device according to a second embodiment will be described with reference to FIG. 8 and FIG. 9. FIG. 8 is a schematic configuration diagram of a fixing device 36 which is viewed from a side. FIG. 9 is an enlargement side view which illustrates a configuration of main portions of the fixing device 36.

In the fixing device 36 in FIG. 8, a difference from the configuration in FIG. 2 is that a moisture absorbing layer 61 with a heat-insulating property (hereinafter, referred to as heat-insulating moisture absorbing layer), and a heat pipe 62 are arranged, instead of the moisture absorbing layer 47. The heat-insulating moisture absorbing layer 61 is formed of a heat-insulating material and a moisture absorbing material. The heat pipe 62 is arranged between the pressurizing pad 46 and the heat-insulating moisture absorbing layer 61.

The heat-insulating moisture absorbing layer 61 and the heat pipe 62 configure a heat leveling member which promotes heat leveling of the fixing belt 41 in the axial direction.

Since configurations of the fixing belt 41, the pressurizing roller 42, the IH coil unit 43, the magnetic member 44, the frame 45, the shield 48, and the spring 49 are the same as those in FIG. 2, detailed descriptions will be omitted.

The heat-insulating moisture absorbing layer 61 adsorbs moisture of 50 mg/m$^3$ to 800 mg/m$^3$ per unit volume under a circumstance of a temperature of 25° C., and a relative humidity of 10% or more, for example. In the heat-insulating moisture absorbing layer 61, an amount of moisture adsorption decreases by discharging moisture (water vapor) when being heated. Furthermore, in the heat-insulating moisture absorbing layer 61, heat conductivity $\lambda$ from the heat pipe 62 to the frame 45 side becomes $\lambda$=0.01 W/m/K to 1.0 W/m/K.

The heat-insulating moisture absorbing layer 61 is formed by performing filling of the non-organic moisture absorbing material and the organic moisture absorbing material between fibers of heat insulating material. As the fiber of heat insulating material, ceramic paper, glass wool, cellulose fiber, or the like, is used. As the non-organic moisture absorbing material, zeolite, silica gel, or the like, is used. As the organic moisture absorbing material, polyurethane, acryl, or the like, is used.

Heat conductivity of the above described moisture absorbing material is 0.2 W/m/K to 1.0 W/m/K, in contrast to heat conductivity of a heat insulating material which is 0.01 W/m/K to 0.2 W/m/K. Accordingly, possible to change heat conductivity from the heat pipe 62 to the frame 45 side by adjusting a filling ratio of the moisture absorbing material to the heat insulating material.

When a filling ratio of the moisture absorbing material is lowered, a maximum adsorption amount of moisture which can be adsorbed decreases, however, possible to lower heat conductivity. In contrast to this, when a filling ratio of the moisture absorbing material is increased, heat conductivity increases, however, possible to increase a maximum adsorption amount of moisture which can be adsorbed.

The heat pipe 62 is arranged between the pressurizing pad 46 and the heat-insulating moisture absorbing layer 61, and communicates therewith in the axial direction of the fixing belt 41. The thickness of the heat pipe 62 is approximately 2 mm, for example, the width in a direction orthogonal to the longitudinal direction is approximately 6 mm, and has a high heat transfer property in the axial direction. A recessed portion 461 is formed inside the pressurizing pad 46, and the heat pipe 62 may be incorporated with the recessed portion 461. The heat pipe 62 may be arranged in the axial direction by being divided into a plurality of pipes. Heat of the fixing belt 41 is transferred to the heat pipe 62 from the pressurizing pad 46, and becomes uniform in the axial direction.

When a fixing speed using the fixing device 36 is accelerated, a temperature rise of the fixing belt 41 in the non-contact region with the sheet S becomes more remarkable. In contrast, by the heat pipe 62, it is possible to increase heat conductivity of the fixing belt 41 in the axial direction, and to promote heat leveling.

Meanwhile, when a temperature of the heat pipe 62 rises, an internal pressure increases, and there is a possibility that the heat transfer property may decrease. When, the internal pressure of the heat pipe 62 increases due to a high temperature, there is a danger of explosion. However, according to the second embodiment, there is an endothermic reaction when the heat-insulating moisture absorbing layer 61 discharges water vapor. For this reason, the heat pipe 62 which comes into contact with the heat-insulating moisture absorbing layer 61 is cooled down using the heat-insulating moisture absorbing layer 61. As a result, it is possible to suppress a temperature rise of the fixing belt 41, finally, and possible to increase reliability of the fixing device 36.

The heat pipe 62 tends to transfer heat from the pressurizing pad 46 to the frame 45 side, as well. However, possible to suppress heat transfer to the frame 45 side using the heat-insulating moisture absorbing layer 61. Accordingly, it is possible to prevent heat of the fixing belt 41 from leaking toward the frame 45, and to accelerate a startup time of the fixing device 36.

FIG. 10A to FIG. 10C are explanatory diagrams which illustrate evaluation results which are obtained by performing evaluations of a heat leveling effect, and a startup time of the fixing belt 41, when the fixing device 36 in FIG. 8 is used. In the evaluation, a fixing device using a fixing device of the multifunction peripheral "e-STUDIO 5055C" made by Toshiba TEC Corporation which is commercially available as a base, in which a heat pipe and a heat-insulating moisture absorbing layer are arranged between a pressurizing pad and a frame which are manufactured using aluminum, is used.

As the heat pipe, two flat-type copper-water heat pipes with a thickness of 2 mm, and a length of 150 cm are used by being arranged in series in the axial direction. As the heat-insulating moisture absorbing layer, a layer which is obtained by mixing particulate zeolite in cellulose fiber as a moisture absorbing material is used, and a heat-insulating moisture absorbing layer with a thickness of 1 mm, a width of 340 mm, and a height of 10 mm is provided between the heat pipe and the frame.

The heat-insulating moisture absorbing layer which is manufactured in this manner obtains an ability of absorbing moisture of 0.34 g under a circumstance of a temperature of 25° C., and a relative humidity of 40%. Printing is continuously performed at a printing speed of 50 pieces/min, and a temperature difference ΔT (° C.) between temperatures at an end portion and a center portion of the fixing belt at a point of time when integrated number of printed sheets reaches 250 pieces is set to an evaluation index of heat leveling.

In addition, a startup time N (sec) from a stop state of the fixing device until a printable state through a state in which a temperature of the fixing belt reaches a set temperature is set to an evaluation index of a startup performance. Furthermore, as a comparison example of the second embodiment, a fixing device in which a heat pipe and a frame come into direct contact, without a heat-insulating moisture absorbing layer, is used.

The evaluation results are illustrated in FIG. 10A. As illustrated in FIG. 10A, in the fixing device according to the second embodiment, both the temperature difference ΔT and the startup time N are reduced compared to those of the comparison example. Accordingly, confirmed that heat leveling is promoted, and startup can be accelerated.

FIG. 10B illustrates a state of a temperature of the fixing belt in the axial direction in the second embodiment. FIG. 10C illustrates a state of a temperature of the fixing belt in the axial direction in the comparison example. That is, in the second embodiment, a temperature of the non-contact region with the sheet is 205° C., when a temperature of the contact region with the sheet of the fixing belt is 150° C. The difference ΔT is 55° C. In contrast to this, in the comparison example, a temperature of the non-contact region with the sheet is 215° C., when a temperature of the contact region with the sheet of the fixing belt is 150° C. The difference ΔT is 65° C., and it is understood that a temperature difference is large.

A time in which a temperature of the fixing belt reaches a fixable temperature from a room temperature (25° C.) is set to a startup time. The startup time in the comparison example is 42 seconds in contrast to 34 seconds in the second embodiment. Accordingly, the second embodiment is possible to reduce the startup time by approximately 8 seconds.

As described above, in the fixing device according to the second embodiment, heat leveling of the fixing belt is promoted, and possible to execute high speed startup.

While certain embodiments have been described, these embodiments have been presented by way of example only, and are not intended to limit the scope of the invention. Indeed, the novel apparatus described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

What is claimed is:

1. A fixing device which fixes a toner image formed on a recording medium onto the recording medium, the device comprising:

a cylinder-shaped rotatable fixing belt which heats and melts a toner image formed on the recording medium;

a pressurizing rotating member which is arranged so as to face the fixing belt along an axial direction, and transports the recording medium by rotating along with the fixing belt;

a pressurizing member which is arranged inside the fixing belt, and forms a nip portion by pressing the fixing belt from an inner peripheral portion toward the pressurizing rotating member side;

a support member which supports the pressurizing member; and a moisture absorbing layer which is arranged between the support member and the pressurizing member, absorbs moisture in air, and discharges the absorbed moisture according to a temperature rise.

2. The device of claim 1, wherein a plurality of openings which are formed along a longitudinal direction are included in at least one of the support member and the pressurizing member.

3. The device of claim 2, wherein the plurality of openings are formed much more at both end portions of at least one of the support member and the pressurizing member than a center portion in the longitudinal direction.

4. A fixing device which fixes a toner image formed on a recording medium onto the recording medium, the device comprising:

a cylinder-shaped rotatable fixing belt which heats and melts a toner image formed on the recording medium;

a pressurizing rotating member which is arranged so as to face the fixing belt along an axial direction, and transports the recording medium by rotating along with the fixing belt;

a pressurizing member which is arranged inside the fixing belt, and forms a nip portion by pressing the fixing belt from an inner peripheral portion toward the pressurizing rotating member side;

a support member which supports the pressurizing member;

a heat pipe which is attached to a position of the pressurizing member on a side opposite to the fixing belt; and a moisture absorbing layer with a heat-insulating property which is fixed to the pressurizing member so as to come into contact with the heat pipe, absorbs moisture in air, and discharges the absorbed moisture according to a temperature rise, and has preset heat conductivity.

5. The device of claim 4, wherein the heat conductivity $\lambda$ of the moisture absorbing layer with the heat-insulating property is 0.01 W/m/K to 1.0 W/m/K.

6. An image forming apparatus comprising:

an image forming unit which forms a toner image on a recording medium; and a fixing device which fixes the toner image onto the recording medium, wherein the fixing device includes a cylinder-shaped rotatable fixing belt which heats and melts a toner image formed on the recording medium;

a pressurizing rotating member which is arranged so as to face the fixing belt along an axial direction, and transports the recording medium by rotating along with the fixing belt;

a pressurizing member which is arranged inside the fixing belt, and forms a nip portion by pressing the fixing belt from an inner peripheral portion toward the pressurizing rotating member side;

a support member which supports the pressurizing member; and a heat leveling member which is arranged between the support member and the pressurizing member, includes a moisture absorbing layer which absorbs moisture in air, and discharges the absorbed moisture according to a temperature rise, and makes a temperature of the fixing belt in an axial direction uniform.

7. The apparatus of claim 6, further comprising:

a plurality of openings which are formed along a longitudinal direction in at least one of the support member and the pressurizing member, in order to perform absorbing and discharging of moisture by the moisture absorbing layer.

8. The apparatus of claim 6, wherein the heat leveling member includes a heat pipe which is attached to a position of the pressurizing member on a side opposite to the fixing belt, wherein the moisture absorbing layer is a moisture absorbing layer with a heat-insulating property which has preset heat conductivity, and wherein the moisture absorbing layer with the heat-insulating property is fixed to the pressurizing member so as to come into contact with the heat pipe.

* * * * *